United States Patent [19]

Suessenbeck et al.

[11] 4,344,354

[45] Aug. 17, 1982

[54] VALVE ARRANGEMENT FOR CONTROLLING THE STROKE OF A TELESCOPING PROP

[75] Inventors: Heinrich Suessenbeck, Zeltweg; Gottfried Siebenhofer, Vienna; Rienhard Neuper, Judenburg; Alfred Zitz, Zeltweg, all of Austria

[73] Assignee: Voest-Alpine Aktiengesellschaft, Vienna, Austria

[21] Appl. No.: 121,583

[22] Filed: Feb. 14, 1980

[30] Foreign Application Priority Data

Mar. 14, 1979 [AT] Austria ..... 1919/79

[51] Int. Cl.[3] ..... F15B 11/18

[52] U.S. Cl. ..... 91/168; 91/446; 91/452

[58] Field of Search ..... 91/168, 173, 169, 170 MP, 91/189 R

[56] References Cited

U.S. PATENT DOCUMENTS

| | | | |
|---|---|---|---|
| 1,963,286 | 6/1934 | Ballert | 91/168 |
| 2,716,965 | 9/1955 | Klamp | 91/168 |
| 3,188,917 | 6/1965 | Auoyle | 91/168 |
| 3,832,937 | 9/1974 | Moore et al. | 91/168 |
| 4,191,092 | 3/1980 | Farmer | 91/168 |

*Primary Examiner*—Paul E. Maslousky

*Attorney, Agent, or Firm*—Cushman, Darby & Cushman

[57] ABSTRACT

The telescopically extendable prop (1) has at the periphery of the intermediate prop (3) abutments (30) which cooperate with a valve (15) before the intermediate prop (3) has attained its highest extended position. The valve (15) stops the extending stroke of the intermediate prop (3) and is releasing the beginning of the extending stroke of the top prop (4). As soon as a predetermined pressure is built up in the consolidating conduit (10) of the top prop (4), the valve (27) subjected to this pressure is overacting the valve (15) cooperating with the abutments (30) of the intermediate prop (3), whereupon the consolidating stroke is completed by pressurizing the intermediate prop (3) with pressurizing fluid. (FIG. 1)

9 Claims, 5 Drawing Figures

VALVE ARRANGEMENT FOR CONTROLLING THE STROKE OF A TELESCOPING PROP

Figure 2:
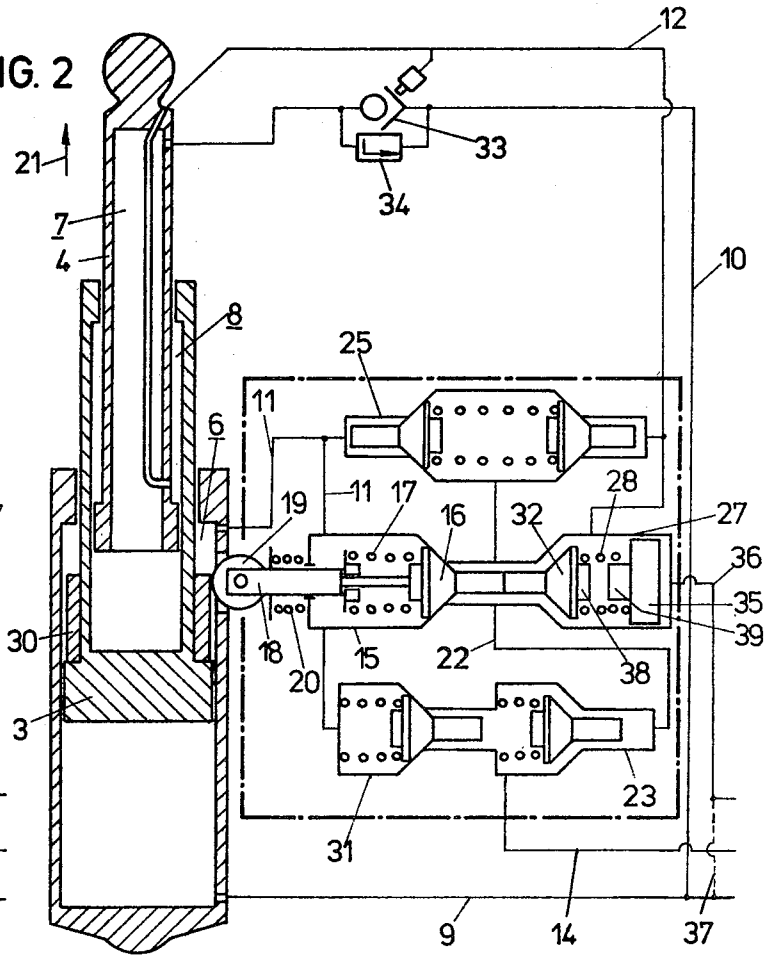

The present invention refers to a valve arrangement for controlling the stroke of a telescoping prop, comprising a stationary base prop, an intermediate prop guided in said base prop and at least one top prop guided in said intermediate prop, noting that at least one valve is provided for being controlled in dependence on the shifting path of the intermediate prop. Such telescoping props are, for instance, used for consolidating mines. When using telescoping twin-props, such props are, as a rule, operated such that at first the prop having the greater diameter and then the prop having the smaller diameter is being extended, however, this results, with constant pressure of the hydraulic fluid, in the maximum possible supporting force remaining far below the nominal force in view of the smaller active surface of the smaller prop.

The invention now aims at controlling a telescoping plural prop by means of a prop control valve such that the supporting force is being exerted via the prop having the greater diameter or the greater cross section, respectively, so that the supporting force corresponds to a higher proportion of the nominal supporting force in spite of the pressure remaining constant. For resolving this task the valve arrangement according to the invention is characterized in that the valve provided within a conduit leading to the working space of the intermediate prop and being controlled in dependence on the shifting path of the intermediate prop is delimiting the consolidating stroke of the intermediate prop prior to the maximum stroke of the intermediate prop and is giving free the lifting movement of one of the top props, and in that at least one valve controlled by the pressure of the pressurized fluid is positioned in one conduit coming from the deconsolidating space of one of the top props for becoming closed when the pressure within the consolidating space (working space) of this top prop exceeds a predetermined value, noting that the pressure-controlled valve coordinated to the last top prop is opening the valve controlled by the shifting path of the intermediate prop and provides for the possibility to subject the intermediate prop to a supporting pressure exceeding the predetermined pressure of the pressure-controlled valve or valves. Such a valve arrangement is capable of exerting a supporting pressure coming close to 80% of the nominal supporting pressure. The valve being controlled in dependence on the shifting path of the intermediate prop, i.e. the prop having the great diameter, will interrupt supply of pressurized fluid prior to the intermediate prop having reached its maximum consolidating stroke, noting that this valve will interrupt supply of pressurized fluid when interpositioned in the conduit leading to the consolidating space and will shut off discharge of pressurized fluid from the deconsolidating space when being interpositioned into the conduit leading from the deconsolidating space. Simultaneously, one of the top props is given free for exerting its consolidating stroke, for which purpose either a valve interpositioned into the conduit leading to the consolidating space of the top prop or a valve interpositioned into the conduit leading to the deconsolidating space of the top prop is being opened. By means of the pressure-controlled valve interpositioned in a conduit leading to a consolidating space of a top prop, the consolidating stroke of the top prop can, as soon as the prop contacts the mine roof and thus the pressure within the pump conduit becomes increased, be terminated and the intermediate prop, i.e. the prop having the greater diameter and thus the greater cross-sectional surface area, can be used for establishing the finally required mine roof supporting force. For this purpose, the valve controlled by the shifting path of the intermediate prop will be opened, noting that, if this valve is interpositioned into the pressurizing conduit for the intermediate prop, said conduit will be given free and, if this valve is interpositioned into the deconsolidating conduit of the intermediate prop, pressurizing fluid can be pressed out of the deconsolidating space and the consolidating force is exerted by means of the intermediate prop.

The arrangement is preferably such that the working space of the intermediate prop connected to the valve controlled in dependence on said shifting path is the deconsolidating space of said intermediate prop. This provides the advantage that also in case of any leakage of the valve the props will not sink in, which provides a greater operational security. Likewise, the valve giving free the consolidating stroke of the top prop is, for the same reasons, preferably interpositioned into the conduit leading from the deconsolidating space of the top prop and is, still preferably, formed from the pressure-controlled valve itself which is for control purposes subjected to the pressure existing within the consolidating conduit. As soon as the top prop contacts the mine roof, the pressure existing within the consolidating conduit untill this moment and only being sufficient for carrying the prop weight will become substantially increased and this increased pressure can in a simple manner be used for switching and opening the valve controlled in dependence on the shifting path.

Preferably the arrangement is such that the pressure-controlled valve is designed as spring-loaded check valve opening in direction to the deconsolidating space of the top prop, is controlled to be opened by the valve coordinated to the intermediate prop and controlled in dependence on the shifting path and can be closed under the influence of the pressure of the pressurizing fluid. This provides for a simple and compact valve arrangement by means of which the deconsolidating conduit of the top prop can be kept closed while the intermediate prop is extended for consolidating purposes. As soon as the valve coordinated to the intermediate prop and controlled in dependence on the shifting path becomes closed, the pressure-controlled valve designed as spring-loaded check valve will become opened and the consolidating stroke of the top prop will be given free. The mentioned check valve can now be closed under the influence of the pressure exerted by the pressurizing fluid and can reliably be kept closed by the pressure built up within the deconsolidating conduit of the top prop on extending the intermediate prop, because said check valve is opening in direction to the deconsolidating space of the top prop. In a particularly simple manner, the closure members of the pressure-controlled valve, on the one hand, and of the valve controlled in dependence on the shifting path, on the other hand, are positively coupled one with the other, so that when closing one of said both valves the other of said both valves becomes opened. By means of this simple construction, the supporting pressure or supporting force can reliably be controlled and built up in a fully automatic manner. Preferably, a check valve is, additionally, interpositioned into the pressurizing conduit leading into the consolidating space of the top prop and arranged for opening in direction to this consolidating space, the opening movement of this check valve being, in addition, controllable by the pressure existing within the conduit leading to the deconsolidating space of the top prop. By means of this check valve, the pressure built up within the consolidating space of the top prop can reliably be maintained, noting that this check valve can be controlled by the pressure prevailing within the conduit leading to the deconsolidating space of the top prop when it is desired to collapse the prop so that the pressurizing fluid can, when collapsing the prop, flow off from the consolidating space of the top prop. For collapsing the prop, the deconsolidating conduit is subjected to pressure, and, preferably, a spring-loaded check valve is connected with the deconsolidating space of the intermediate prop, said check valve opening in direction to said deconsolidating space and being arranged in shunt-connection with respect to the valve controlled in dependence on the shifting path. This check valve will thus open only if the deconsolidating conduit is subjected to a pressure exceeding the pressure existing within the consolidating conduit and/or if the pressure within the consolidating conduit is brought to zero.

For collapsing a positioned prop it is of advantage if the deconsolidating conduit is connected via a check valve opening in direction to the deconsolidating conduit with the pressure-controlled valve connected with the deconsolidating space of the top prop as well as with the valve controlled in dependence on the shifting path and opening in direction to the deconsolidating space of the intermediate prop. In this manner, the sinking movement of the props can be controlled in a suitable manner when deconsolidating the props.

In a particularly simple embodiment the arrangement is such that the closure member of the valve controlled in dependence of the shifting path is connected with a spring-loaded tappet, particularly a roller tappet, cooperating with abutments located within the shifting path of the individual prop. In this case, the abutments can be formed of a bushing mounted on the outer circumference of the intermediate prop and having such a length that for finally supporting the mine roof by means of the intermediate prop a corresponding portion of the shifting path is still at disposal.

For security reasons it is of advantage if pressure relief valves opening in direction to the deconsolidating conduit are connected to those conduits which lead from the deconsolidating spaces of the top prop and of the intermediate prop to the pressure-dependent valve and the valve controlled in dependence on the shifting path, respectively. These valves form thus a by-pass with respect to the remaining valves of the valve arrangement so that these valves are in case of operational disturbances reliably protected from becoming destroyed. These pressure relief valves can be followed by the check valve opening in direction to the deconsolidating conduit and reliably opening at any rate when the spring becomes destroyed.

The invention is further illustrated with reference to the drawing schematically showing an embodiment of the invention.

In the drawing

Figure 1:
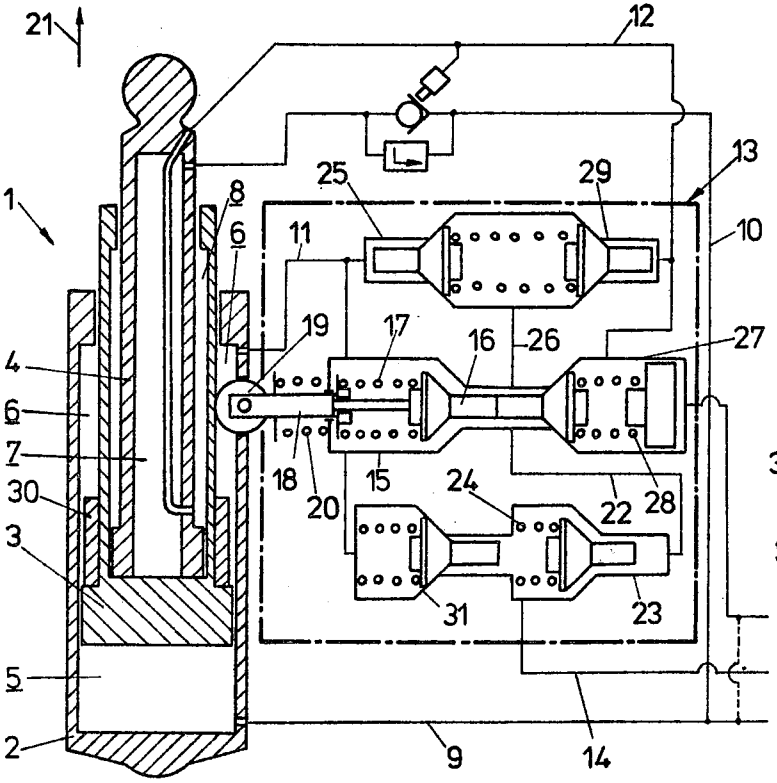
Figure 4:
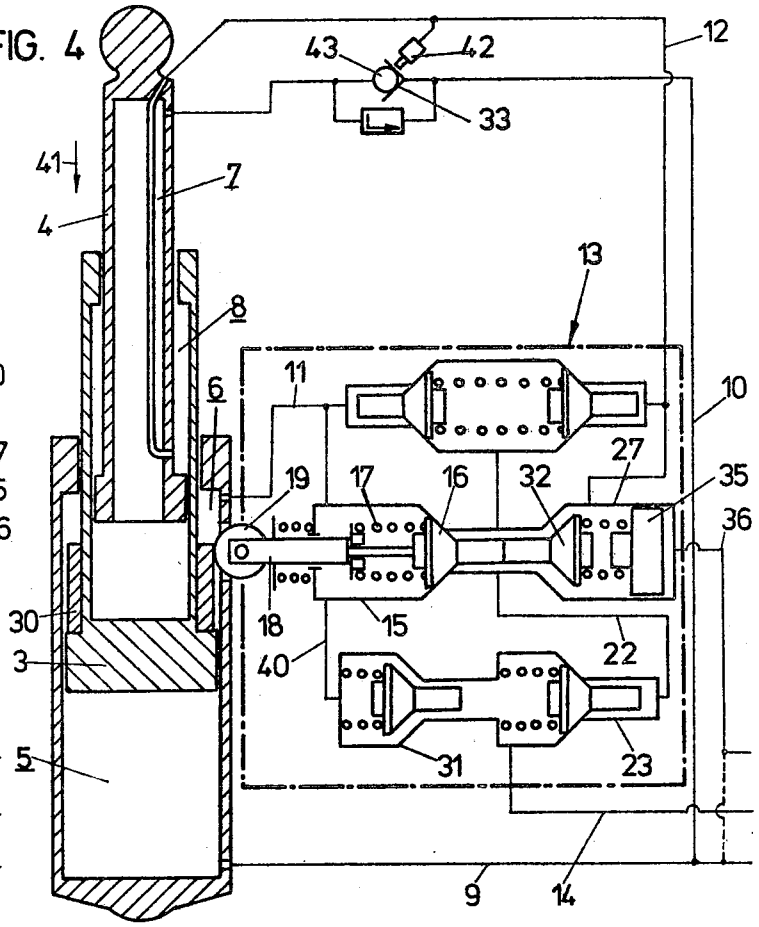
Figure 3:
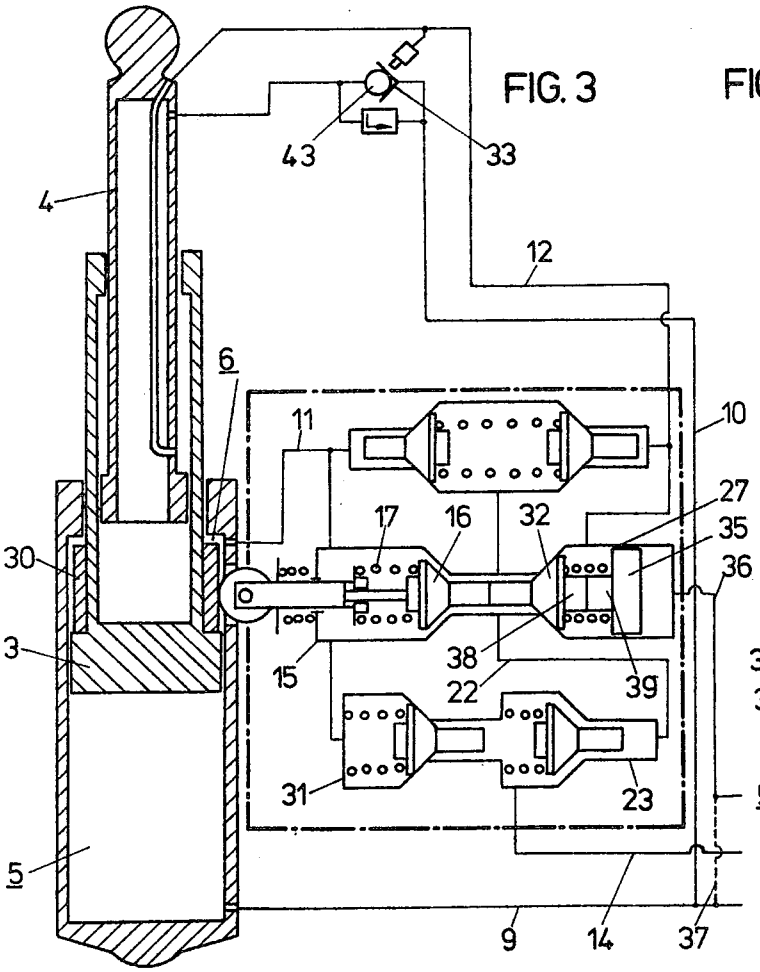
Figure 5:
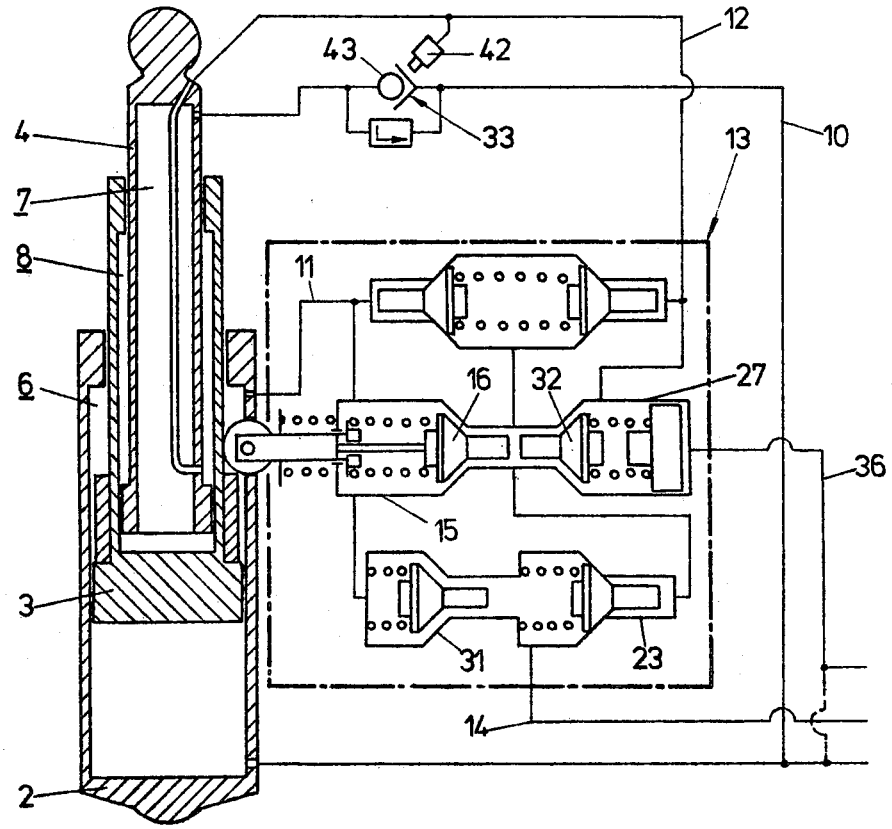

FIGS. 1 to 5 show a valve arrangement according to the invention under different operating conditions, noting that FIG. 1 is illustrating the begin of the mine roof consolidating step and extending the intermediate prop, FIG. 2 is illustrating extending of the top prop, FIG. 3 is illustrating the application of the intermediate prop with a great force exerted, FIG. 4 is illustrating the begin of the deconsolidating movement or collapsing of the prop and FIG. 5 is illustrating the further deconsolidating movement.

FIG. 1 shows a telescopically extendable prop 1, comprising a stationary base prop 2, an intermediate prop 3 guided within this stationary base prop and a top prop 4 guided within the intermediate prop 3. The intermediate prop 3 as well as the top prop 4 have two working spaces each, the consolidating space of the intermediate prop 3 being designated 5 and the deconsolidating space of this intermediate prop is designated 6. The consolidating space of the top prop 4 is designated 7 and the deconsolidating space thereof is designated 8. The consolidating conduit 9 is connected to the consolidating space of the intermediate prop. This consolidating conduit is connected with the consolidating space 7 of the top prop 4 via a branch conduit 10. The deconsolidating space 6 of the intermediate prop is connected to a deconsolidating conduit 11. The deconsolidating space 8 of the top prop 4 is connected to a deconsolidating conduit 12. Said both deconsolidating conduits 11 and 12 open with interposition of the valve arrangement 13 into the common deconsolidating conduit 14. The valve arrangement 13 comprises a valve 15 controlled in dependence on the shifting path and opening in direction to the deconsolidating space 6 of the intermediate prop 3 and being interconnected into the deconsolidating conduit 11. The closure member 16 of this valve is in connection with a roller tappet 18 with a spring 17 being interpositioned. The roller 19 of this roller tappet is cooperating with the outer surface of the intermediate prop. In the first stage of the mine roof consolidating movement shown in FIG. 1, the closure member 16 is kept in open position by means of a spring 20. When subjecting the consolidating space 5 to the pressure of pressurizing fluid supplied via the consolidating conduit 9, the intermediate prop 3 is extended in direction of arrow 21 and the pressurizing fluid present within the deconsolidating space 6 is flowing through the deconsolidating conduit 11 to the valve 15 controlled in dependence on the shifting path, via the closure member 16 assuming opened position and via a conduit 22 to a check valve 23 opening in direction to the deconsolidating conduit 14, noting that the pressurizing fluid forced out of the deconsolidating space 6 overacts the spring 24 of the check valve 23. In by-pass connection to the valve 15 controlled in dependence on the shifting path a pressure relief valve 25 is provided which is connected to the deconsolidating conduit 11 and which remains closed on normal operating conditions. In case of a response of this pressure relief valve 25, the pressurizing fluid coming from the deconsolidating space 6 could, via the pressure relief valve 25 and the conduit 26, enter the conduit 22 and, via the check valve 23, enter into the deconsolidating conduit 14. This would, however, only be the case if the valve 15 controlled in dependence on the shifting path assumes closed position and if also the conduits leading to the top prop are closed. On normal condition, the pressure relief valve 25 will thus give no response at all. The deconsolidating space 8 of the top prop is, during this first initial portion of the extending stroke, closed by valve 27, so that the pressure built up within the consolidating conduit 10 leading to the consolidating space 7 of the top prop does not effect shifting movement of the top prop in direction of arrow 21. The valve 27 is, for this purpose, formed as spring-loaded check valve opening in direction to the deconsolidating space 8 of the top prop and is kept closed by the pressure existing within the deconsolidating conduit 12. In by-pass connection to this valve 27, there is provided a pressure relief valve 29 remaining closed on normal operating conditions. If this pressure relief valve 29 is opened, the presurizing fluid can flow off into the deconsolidating conduit 14 via the conduits 26, 22 and the check valve 23 and thus leave the deconsolidating conduit 12. The consolidating stroke of the intermediate prop 3 in direction of arrow 21 is now effected until the roller 19 of the roller tappet 18 collides with the bushing 30 as is shown in FIG. 2.

As soon as the roller tappet 18 is overacting the force of the spring 20 to pass the bushing 30, the closure member of the valve 15 controlled in dependence on the shifting path will close and pressurizing fluid can no more flow out of the deconsolidating space 6 of the intermediate prop 3. Only in case of operational disturbances the pressure relief valve 25 could be actuated, howevever this will not occur on normal operation conditions. In any case the check valve 31 provided in by-pass connection to the valve 15 controlled in dependence on the shifting path and connected to the deconsolidating conduit 11 and opening in direction the deconsolidating space 6 is kept closed by the pressure existing in the deconsolidating conduit 11 so that the intermediate prop 3 is prevented from becoming further extended or moved in direction of arrow 21. Simultaneously with the closing movement of the closure member 16, the closure member 32 of the valve 27 becomes lifted off its seat in view of the closure member 16 and 32 being positively connected one with the other. By opening the valve 27, the deconsolidating conduit 12 of the top prop 4 becomes opened and the pressurizing fluid pressed into the consolidating space 7 via the consolidating conduit 10 and the check valve 33 opening into the consolidating space 7 of the top prop 4 is pressing out the pressurizing fluid from the deconsolidating space 8 of the top prop, noting that this pressurizing fluid is flowing into the deconsolidating conduit 14 via the deconsolidation conduit 12, the valve 27, the conduit 22 and the check valve 23 opening in direction to the deconsolidating conduit 14. In parallel connection relative to the check valve 33 opening in direction to the consolidation space 7 of the top prop 4, a pressure relief valve 34 is provided for protecting the top prop.

A piston 35 is slidably guided within the valve 27 and has one of its surfaces subjected to the pressure existing in the conduit 26 for pressurizing fluid. This conduit 36 for pressurizing fluid can be connected in a simple manner, for example by means of a slide valve not shown, with the consolidating conduit 9 and 10, respectively. The corresponding connection is schematically shown at 37. For extending the top prop only a pressure slightly overcompensating the weight of the top prop is required, said pressure being, as a rule, approximately within the range of 20 to 30 bar. As soon as the top prop 4 having the smaller diameter contacts the mine roof, the pressure existing within the consolidating conduit 10 and thus also within the consolidating conduit 9 can becomes increased to pump pressure which, as a rule, assumes a value between 200 and 330 bar. Simultaneously, also the pressure within the conduit 36 will become increased and the piston 35 provided within the valve 27 is moved in left-hand direction against the force of the spring 28 and contacts the closure member 32. The corresponding cooperating abutments are designated 38 and 39.

Subsequently the closure member 32 of the valve 27 is pressed into its closed position, noting that the closure member 16 is moved in its opened position shown in FIG. 3 by the closure member 32 against the force of the spring 17.

The meanwhile essentially increased pump pressure is fed via the consolidating conduit 9 to the consolidating space 5 of the intermediate prop 3, noting that pressurizing fluid can flow out of the deconsolidating space 6 of the intermediate prop 3 via the deconsolidating conduit 11 of the intermediate prop, the now opened valve 15, the conduit 22 and the valve 23 into the common deconsolidating conduit 14. Mine roof consolidating is thus effected under high pressure by means of the greater cross-sectional area of the intermediate prop 3 having the greater diameter, so that the pump pressure can be used with higher efficiency without surpassing the admissible nominal load of the props.

Deconsolidating or collapsing of the props by using the valve arrangement 13 is now shown in FIGS. 4 and 5. For this purpose the pressure is being reduced in the consolidating conduits 9 and 10 and pressurizing fluid is pressed into the deconsolidating conduit 14. This pressurizing fluid keeps the check valve 23 closed which opens in direction to the deconsolidating conduit 14, the check valve 31 opening in direction to the deconsolidating space 6 of the intermediate prop 3 can, however, become opened so that the pressurizing fluid can flow out of the deconsolidating space 6 of the intermediate prop via the deconsolidating conduit 11 of the intermediate prop and a conduit 40 so that the intermediate prop 3 is sinking down in direction of arrow 41. In view of no pressure effecting a shifting movement of the piston 35 existing within the conduit 36, the valve 27 is in this stage opened by the force of the spring 17 of the valve 15 controlled in dependence on the shifting path, in its turn now again closed, and the closure member 16 assuming closing position is forcing the closure member 32 of the pressure-dependent valve 27 into opened position. The top prop 4 is not retracted during this first stage of deconsolidating because the consolidating space 7 of this top prop is kept closed by the check valve 33 opening in direction to the consolidating space 7. The deconsolidating conduit 12 leading to the deconsolidating space 8 of the top prop is in this stage substantially non-pressurized and is, via the opened valve 27 and the conduit 22, in connection with the valve 23 maintained in closed position by the pressure existing within the deconsolidating conduit 14. As soon as the roller 19 of the roller tappet 18 no more contacts the bushing 30 of the intermediate prop 3, the closure member 16 of the valve 15 controlled in dependence on the shifting path is lifted off its seat and the pressurizing fluid within the deconsolidating conduit 14 is not only in direct connection with the consolidating space 6 of the intermediate prop 3 via the deconsolidating conduit 11 but can also enter the deconsolidating conduit 12 of the top prop via the check valve 27 opening in direction to the deconsolidating space 8 of the top prop, noting that the closure member 32 of the check valve 27 becomes disengaged from the closure member 16 of the valve 15 controlled in dependence of the shifting path. This is shown in FIG. 5.

Sinking-in movement of the top prop 4 is now made possible by the closure member 43 of the check valve 33 interpositioned into the consolidating conduit 10 becoming lifted by the pressure existing in the deconsolidating conduit 12 and by a device 42. Pressurizing fluid can now be supplied to the deconsolidating space 8 of the top prop 4 via the deconsolidating conduit 12, noting that pressurizing fluid can flow out of the consolidating space 7 of this top prop into the consolidating conduit 10 via the check valve 33 maintained in open position. Now also the top prop will sink in, noting that the top prop will sink in with a higher speed than the intermediate prop 3 in view of the smaller volume of pressurized fluid to be expelled. In this manner, it is achieved that the top props are reliably completely retracted for again consolidating the prop so that the extending stroke of the top prop is kept as small as absolutely required, because a top prop of smaller diameter has, of course, a smaller load resistance, above all with respect to bending forces, than the intermediate prop having the greater diameter.

What is claimed is:

1. Valve arrangement for controlling the stroke of a telescoping prop comprising a stationary base prop, an intermediate prop guided in said base prop, said intermediate prop having a consolidating space and a deconsolidating space and being capable of effecting a mine roof consolidating stroke, at least one top prop guided in said intermediate prop, said top prop having a consolidating space and a deconsolidating space, at least one first valve controlled in dependence on the shifting path of the intermediate prop, said valve being provided in a first conduit leading to the deconsolidating space of the intermediate prop and functioning to delimit the mine roof consolidating stroke of the intermediate prop prior to attaining the maximum consolidating stroke thereof, said valve also releasing the lifting stroke of the top prop, and a second valve controlled by the pressure of the pressurized fluid interpositioned in a second conduit coming from the deconsolidating space of the top prop for becoming closed when the pressure within the consolidating space of the top prop exceeds a predetermined value, said second valve functioning to open the valve controlled by the shifting path of the intermediate prop and to provide for the possibility to subject the intermediate prop to a mine roof supporting pressure exceeding the predetermined pressure of said second valve.

2. Valve arrangement as claimed in claim 1 including a third conduit connecting said consolidating space of said intermediate prop with said deconsolidating space of said top prop and wherein said second valve is controlled by the pressure existing in said third conduit.

3. Valve arrangement as claimed in claim 1 wherein said second pressure-controlled valve is a spring-loaded check valve opening in direction to the deconsolidating space of the top prop, can be brought in open position by said first valve and is coordinated to the intermediate prop and is adapted to be closed under the action of the pressure of the pressurizing fluid.

4. Valve arrangement as claimed in claim 1 wherein each of said first and second valves includes a closure member, said closure members being positively connected one with the other such that closing of one of said valves effects opening the other of said valves.

5. Valve arrangement as claimed in claim 1 including a check valve interpositioned into said third conduit said check valve being openable in the direction of said consolidating space of said top prop, the opening movement of said check valve being additionally controllable by the pressure existing in said second conduit.

6. Valve arrangement as claimed in claim 1 including a spring-loaded check valve connected with and openable into said deconsolidating space of said intermediate prop, said check valve being parallely connected relative to said first valve.

7. Valve arrangement as claimed in claim 1 including a common deconsolidating conduit which is connected, via a check valve opening in direction to said common deconsolidating conduit, connected with said second valve as well as with said first valve.

8. Valve arrangement as claimed in claim 1 wherein said first valve includes a closure member connected with a spring-loaded tappet cooperating with abutments located within the shifting path of said intermediate prop.

9. Valve arrangement as claimed in claim 1 including a common deconsolidating conduit connected with said first and second valves and including pressure relief valves opening in direction to said common deconsolidating conduit connected to said first and second conduits.

* * * * *